United States Patent [19]

Mansfield

[11] Patent Number: 4,970,817

[45] Date of Patent: Nov. 20, 1990

[54] VEHICLE REMOTE OIL FILL APPARATUS

[76] Inventor: Grover Mansfield, 4885 Crescent Dr., Vidor, Tex. 77662

[21] Appl. No.: 37,200

[22] Filed: Apr. 10, 1987

[51] Int. Cl.[5] ..... B67C 11/00; B65B 3/04

[52] U.S. Cl. ..... 141/340; 141/98; 141/330; 141/333; 141/334; 141/337; 141/339; 141/392; 220/85 F; 220/86.2; 184/105.1

[58] Field of Search ..... 184/105; 141/311 R, 141/331–345, 319, 382–389, 392; 220/86 R, 85 F

[56] References Cited

U.S. PATENT DOCUMENTS

| | | | |
|---|---|---|---|
| 1,833,402 | 11/1931 | Mundis | 141/389 |
| 2,144,923 | 1/1939 | Kester et al. | 141/334 |
| 2,189,967 | 2/1940 | Sprouse | 141/334 |
| 2,275,915 | 3/1942 | McDonald | 141/389 |
| 2,578,184 | 12/1951 | Green | 220/86 R |
| 2,775,988 | 1/1957 | Hamner | 141/389 |
| 3,885,547 | 5/1975 | Doepke et al. | 141/342 X |
| 3,927,703 | 12/1975 | Beaubien | 141/333 |
| 3,990,489 | 11/1976 | Ruter | 141/98 |
| 4,239,130 | 12/1980 | Altadonna | 141/332 X |
| 4,267,945 | 5/1981 | Maynard, Jr. | 141/330 X |
| 4,338,983 | 7/1982 | Hatcher | 141/331 |
| 4,347,878 | 9/1982 | Schofield | 141/334 X |
| 4,515,295 | 5/1985 | Salmon | 141/392 X |
| 4,559,984 | 12/1985 | Wycech | 141/340 |
| 4,703,867 | 11/1987 | Schoenhard | 220/85 F |
| 4,739,861 | 4/1988 | Desjardins | 141/330 X |
| 4,856,568 | 8/1989 | Murphy et al. | 141/337 |

*Primary Examiner*—Ernest G. Cusick

*Attorney, Agent, or Firm*—Kenneth D. Baugh

[57] ABSTRACT

A vehicle 10 is provided with a remote oil fill apparatus 12. The remote oil fill apparatus 12 includes a volume chamber 18 coupled to one side of the raised frame 11 of the vehicle 10. A motor 14 having an oil fill opening 16 formed therein is mounted in an intermediate front portion of the vehicle frame 11. A conduit 34 and hose 36 direct the flow of oil from the volume chamber 18 to the oil fill opening 16. A adapter coupler 48 is provided to couple the conduit 34 and hose 36 to the motor 14 in the oil fill opening 16.

2 Claims, 6 Drawing Sheets

VEHICLE REMOTE OIL FILL APPARATUS

TECHNICAL FIELD

This invention relates to a vehicle and a vehicle remote oil fill apparatus to be used on the vehicle to facilitate convenience in replenishing and maintaining oil therein. Vehicle maintenance is very important in assuring proper operation and long life of a vehicle. In a number of instances such maintenance can only be performed by qualified mechanics. However, some functions such as replenishing and maintaining oil in a vehicle can be performed by a layman. Since this is such a vital function to proper vehicle maintenance it is desirable to make this function as easy and convenient as possible to the layman. For some vehicles, such as automobiles, and other small passenger vehicles, the function is reasonable convenient because the user is normally able to reach the appropriate part of the vehicle engine, i.e., the oil fill opening in the engine. However, in larger vehicles, such as, for example 4-wheel drive vehicles and other high wheel based vehicles, access to the oil fill opening in the motor becomes difficult. The difficulty results from the vehicle being so high off the ground. Accordingly there becomes a need to provide a oil fill apparatus for making the vehicle oil replenishing operation convenient to the user regardless of the size of the vehicle.

BACKGROUND ART

Attempts have been made to provide devices to facilitate the replenishing of oil in a vehicle motor. Such devices however mount directly in the oil fill opening of the motor. In these devices the entire device is mounted in the oil fill opening in the motor. Accordingly, these devices can not be readily used to facilitate the replenishing of oil in the larger vehicles because the vehicle normally sets to high off the ground. Thus the user still cannot reach the motor without a ladder or some other device designed to help the user overcome the size of the vehicle.

DISCLOSURE OF THE INVENTION

The invention relates to a remote oil fill apparatus secured to a vehicle. The vehicle is provided having a vertically raised frame. A volume chamber having an inlet and outlet opening is coupled to one side of the vehicle frame. A motor having an oil fill opening formed therein is mounted in an intermediate front portion of the vehicle frame. The frame is vertically raised and the motor mounted thereon so that the oil fill opening is remotely displaced from access by a user. A means is coupled to the volume chamber adjacent the outlet opening for directing the flow of oil from the volume chamber to the motor oil fill opening. A coupling means is provided to couple the oil flow directing means to the motor in the motor oil fill opening.

BRIEF DESCRIPTION OF THE DRAWING

The details of the invention will be described in connection with the accompanying drawing in which.

BEST MODE FOR CARRYING OUT THE INVENTION

Figure 1:
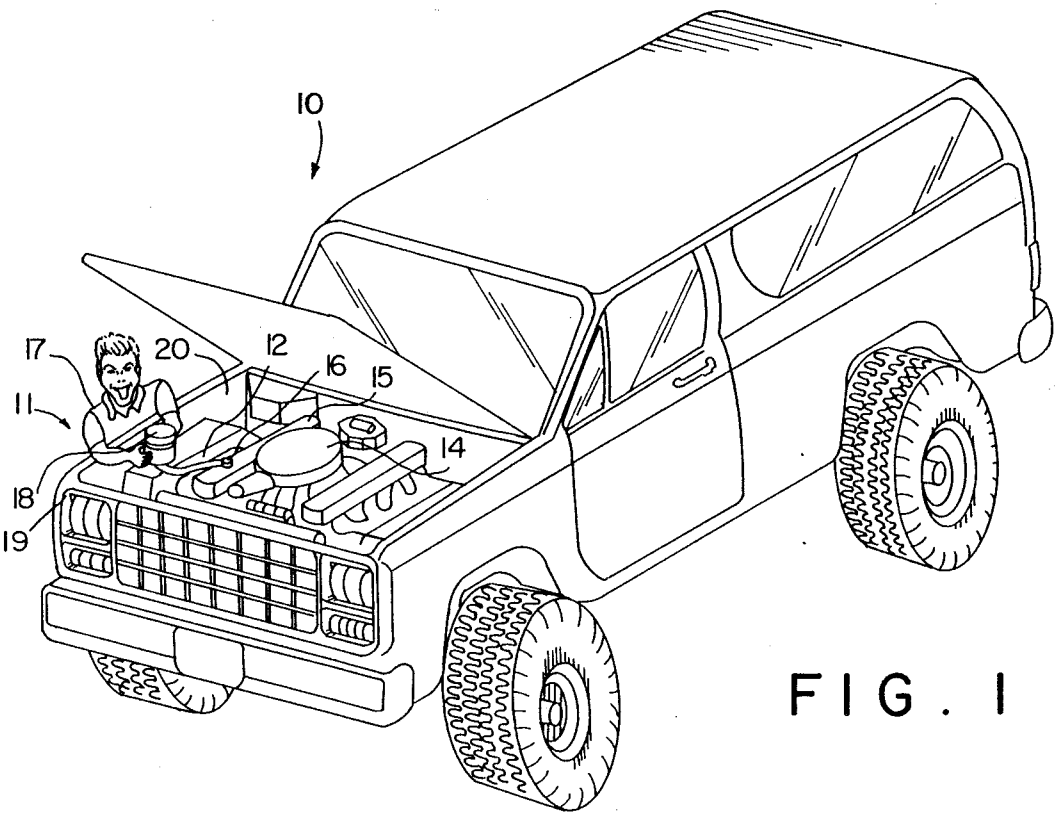
FIG. 1 is a perspective view illustrating the remote oil fill apparatus and vehicle in accordance with the principles of this invention.

Referring to FIG. 1 there is shown, a vehicle generally designated by the numeral 10, including a vertically raised frame generally designated by the numeral 11. A remote oil fill apparatus, generally designated by the numeral 12 is coupled to the vehicle frame 11. The remote oil fill apparatus 12 is provided to facilitate the replenishing of oil in the motor 14 of vehicle 10 through a valve cover oil fill opening 16, formed in a motor valve cover 15. The opening 16 has a slot 19 formed therein. The vehicle 10 is the kind whose frame 11 is vertically raised to the extent that the valve cover oil fill opening 16 in the motor 14 is remotely displaced from access by a user 17. An example of such a vehicle would be the kind commonly referred to as a four wheel drive vehicle. However, the remote oil filer apparatus can be used on any vehicle whose oil fill opening 16 is remotely displaced from access by a user 17.

Figure 2:
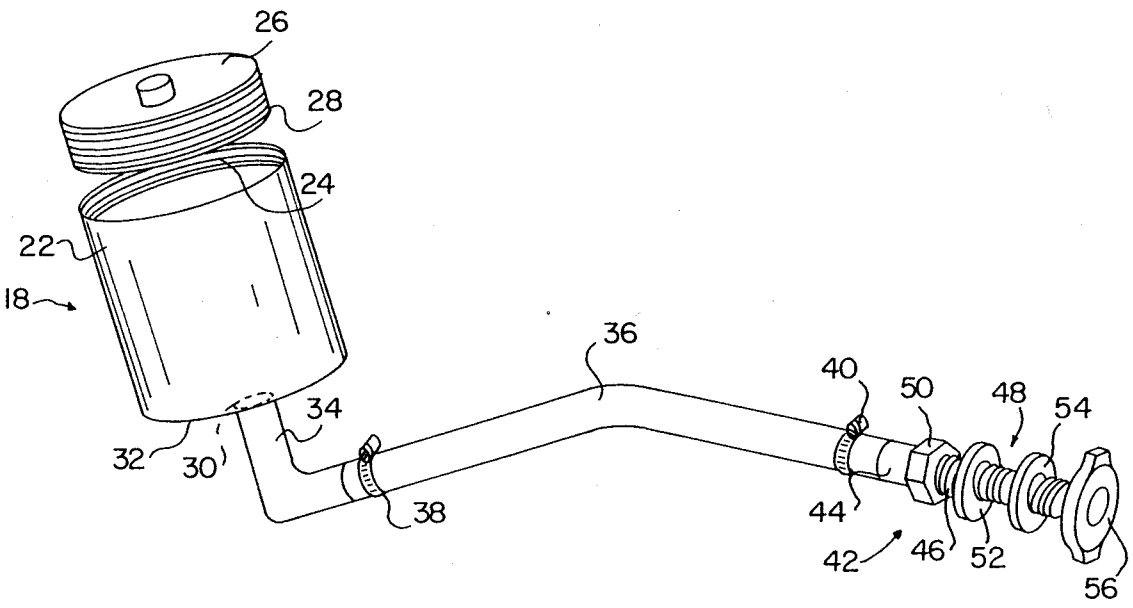
FIG. 2 is a perspective view of the remote oil fill apparatus in accordance with the principles of this invention.

As illustrated in FIG. 2, the remote oil fill apparatus 12 includes a volume chamber, generally designated by the numeral 18, which is coupled to a side wall 20 of the vehicle 10. The volume chamber 18 can be coupled to the side wall 20 by any well known coupling such as for example a screw or even an adhesive. The volume chamber 18 is provided with an inlet opening 21 which provides access to the volume chamber at an upper portion 22 thereof. The volume chamber 18 also includes a plurality of threads 24 which are formed in the upper portion 22 of the volume chamber.

The volume chamber 18 is provided with a cap 26 having threads 28 formed therein that cooperate with the threads 24 to permit sealing of the cap on the volume chamber. The volume chamber 18 further includes an outlet opening 30 formed in a lower portion 32 thereof. An L-shaped conduit or pipe 34 is secured at the lower portion 32 of the volume chamber 18 in the outlet opening 30. A hose 36 is coupled at one end of the conduit 34 by a clamp 38.

The remote oil fill apparatus 12 also includes an adapter coupler generally designated by the numeral 42 which is secured to the other end of the hose 36 by a clamp 40. The adapter coupler 42 is provided to be secured to the valve cover 15 in the oil fill opening 16. The adapter coupler 42 is provided with an elongated member 44 which is coupled to the hose 36 by clamp 40. The elongated member 44 is formed with threads 46 around its periphery.

The elongated member 44 is provided with a locking assembly generally designated by the numeral 48. The locking assembly 48 includes a lock nut 50 threadedly coupled on an uppermost portion of the elongated member 44. A washer 52 is spaced below lock nut 50 between the lock nut and a gasket 54. The elongated member 44 is formed with a rectangular stop 56 thereon opposite the gasket 52.

Figure 3:
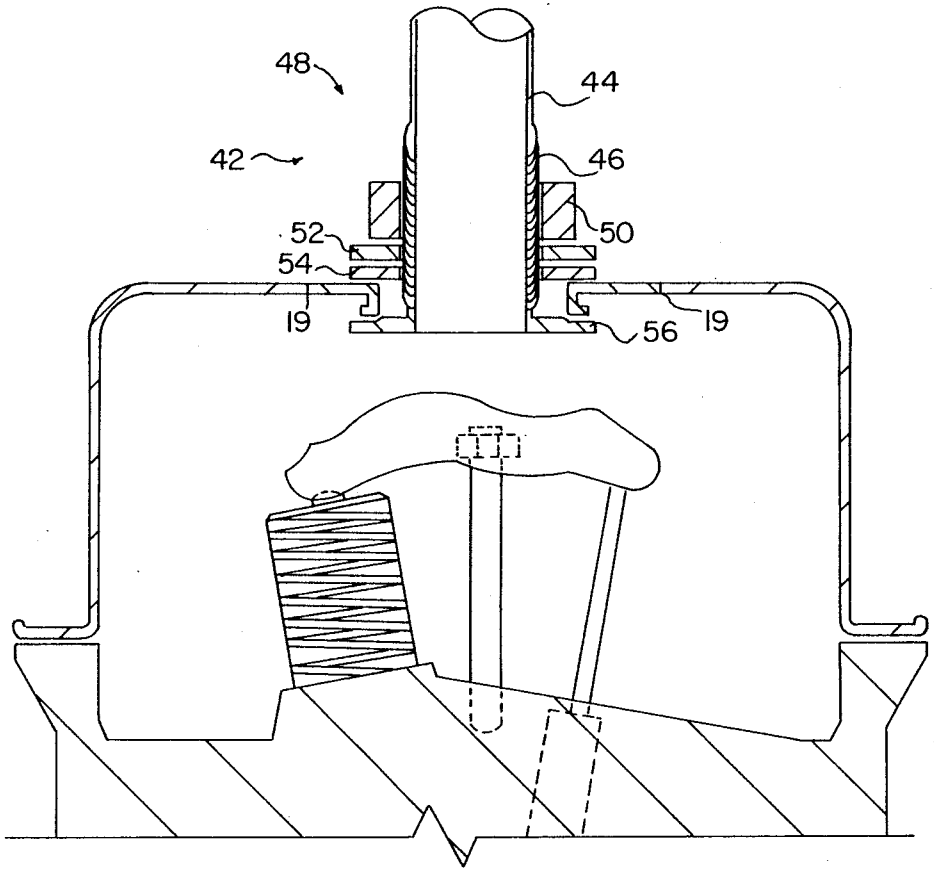
FIG. 3 is a cross-sectional view illustrating the coupling arrangement of the remote oil fill apparatus in accordance with the principles of this invention.

Referring to FIG. 3 in order to couple the adapter coupler 42 to the valve cover 15 the valve cover opening cap (not shown) is removed. The elongated member 44 of the locking assembly 48 is aligned and positioned in the valve cover oil fill opening 16 so that the stop 56 goes through the rectangular slot in the opening. The elongated member 44 is then turned 90 degrees so that the rectangular stop is perpendicular to the rectangular slot in the opening. The gasket 54 and then the washer 52 are positioned adjacent the oil fill opening. The lock nut 50 can then be screwed on the elongated member to a position adjacent the outside of the valve cover 15 as illustrated in phantom in the Figure. This secures the adapter coupler 42 to the motor 14.

As illustrated in FIG. 1, when in use the remote oil fill apparatus 12 is secured to the side wall 20 of the vehicle 10 and coupled by the locking assembly 48 in the oil fill opening 16. A user 17 can then proceed to replenish oil in the vehicle 10 by removing the cap 26 and pouring oil into the volume chamber 18. As the oil is being poured into the volume chamber 18 the oil flows from the chamber through the conduit 34, hose 36 and then into the oil fill opening 16 thereby replenishing oil in the vehicle 10. By using this arrangement the user 17 is relieved of any inconvenience or discomfort that would ordinarily result from the user having to put oil directly into the oil fill opening 16.

Figure 4:
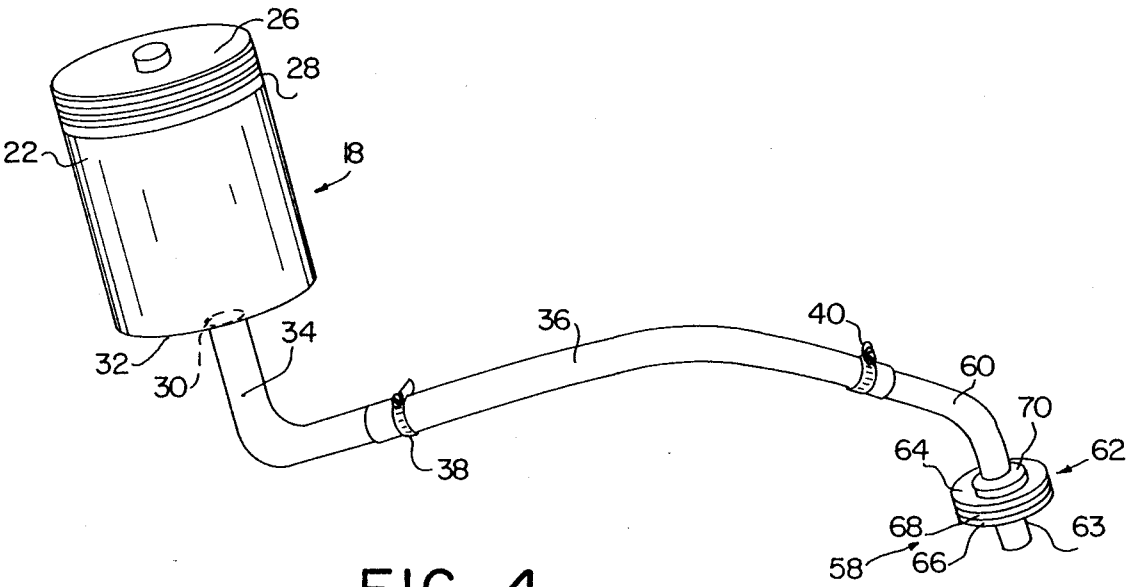
FIG. 4 is a perspective view illustrating a second embodiment of the remote oil fill apparatus in accordance with the principles of the invention.

FIG. 4 illustrates a remote oil fill apparatus 12 provided with an adapter coupler 58 for securing the oil fill apparatus in the oil fill opening 16. The adapter coupler 58 includes an elongated member 60 and a resilient gasket generally designated by the numeral 62. The resilient gasket 62 is formed with an opening 63 therein through which the elongated member 60 is inserted. The gasket 62 is formed with upper and lower walls 64 and 66 respectively and a slot or tract 68 formed between the upper and lower walls. A coupling ring 70 is formed adjacent the upper wall 64 of the gasket 62 to secure the elongated member in the opening 63 of the gasket. The gasket 62 may be made of a resilient material such as for example rubber.

Figure 5:
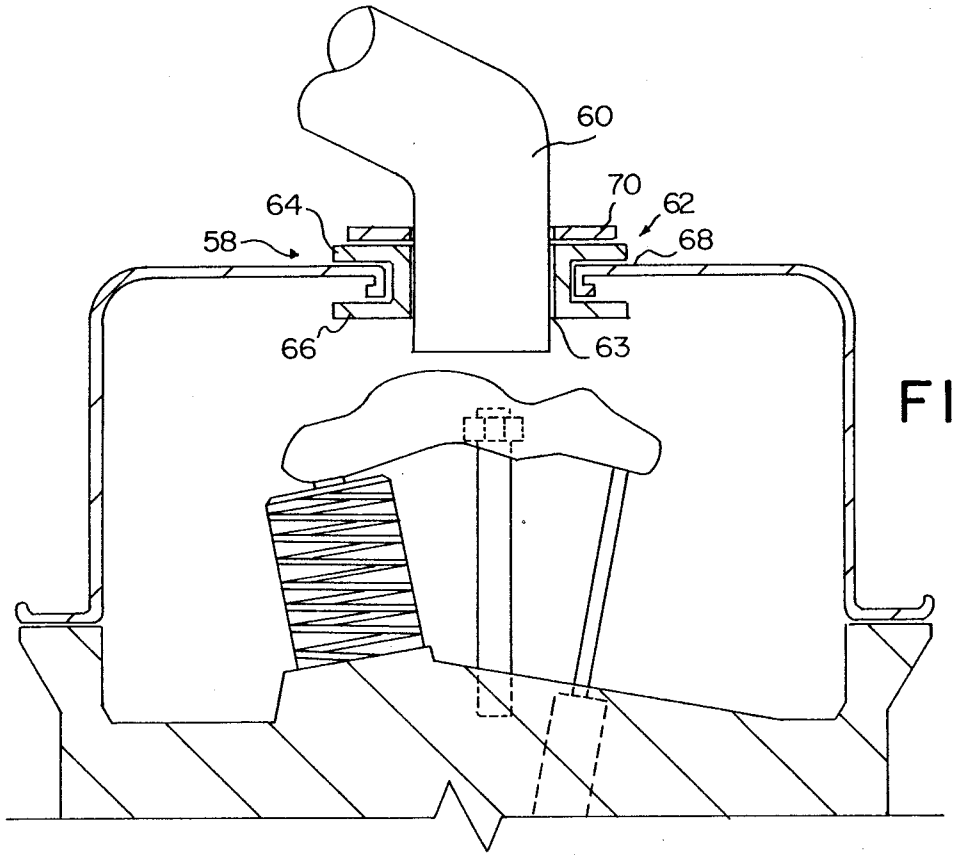
FIG. 5 is a cross-sectional view illustrating the coupling arrangement of the second embodiment of the remote oil fill apparatus in accordance with the principles of the invention.

The adapter coupler 58 is secured in the oil fill opening 16 as illustrated in FIG. 5. When coupling the adapter coupler 58 to the valve cover 15 the gasket 62 is disconnected from the elongated member 60. The gasket 62 is then inserted into the valve cover opening 16 so that portions of the valve cover 15 are aligned in the track 68. The elongated member 60 is then inserted into the gasket until the coupling ring 70 engages the upper wall 64 of the gasket 62. The diameter of the gasket opening 63 is slightly smaller than that of the elongated member 60 thereby allowing a snug fit between the two.

Figure 6:
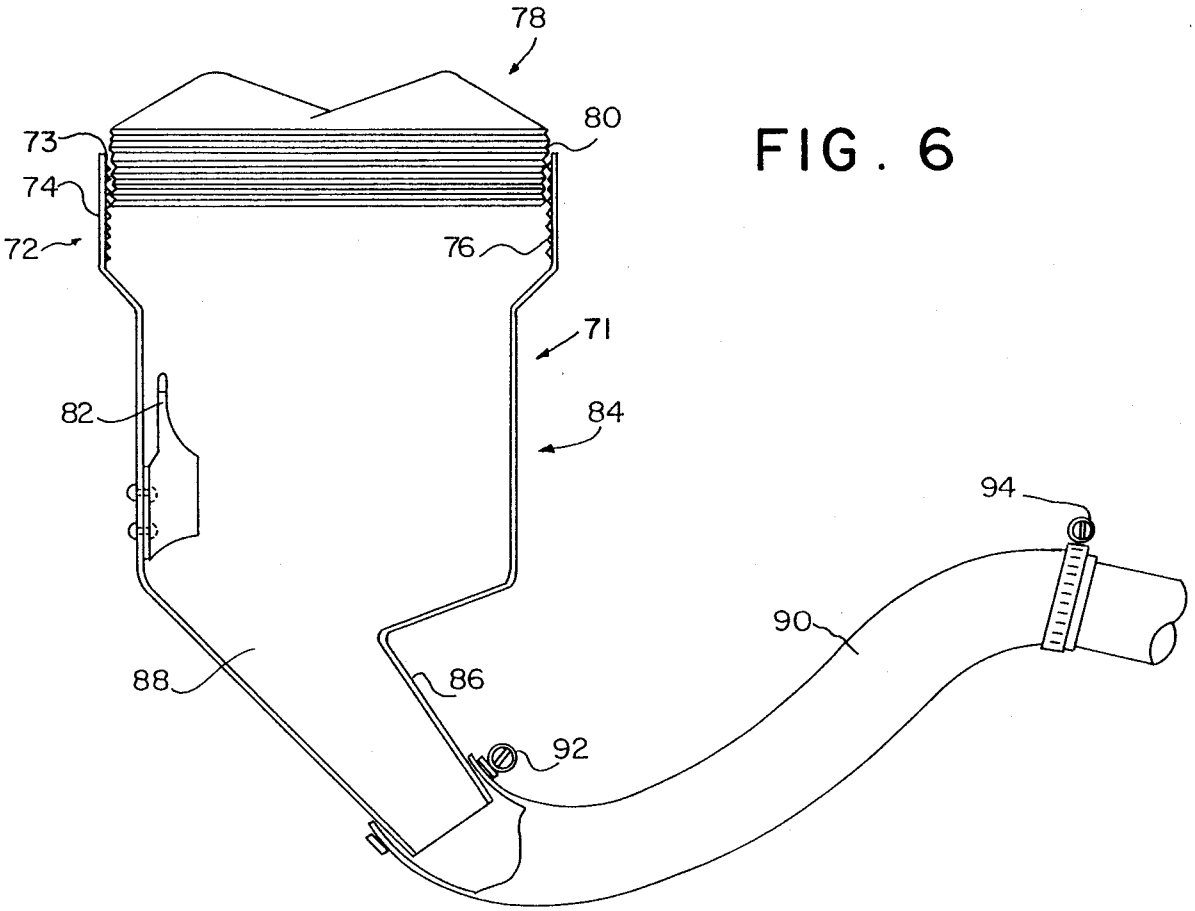
FIG. 6 is a perspective view illustrating a third embodiment of the remote oil fill apparatus in accordance with the principles of the invention.

Referring to FIG. 6 a remote oil fill apparatus 71 is provided. The oil fill apparatus 71 includes a volume chamber generally designated by the numeral 72. The volume chamber 72 is provided with an inlet opening 73 formed at an upper portion 74 of the chamber. The volume chamber 72 also includes a plurality of threads 76 which are formed in the upper portion 74 of the chamber. A cap generally designated by the numeral 78, having threads 80 formed therein to interlock with threads 76 is provided to seal the volume chamber 72.

The volume chamber 72 also includes an opener or cutting member 82. The opener 82 is provided to open a container (not shown) which houses oil that will be poured into the volume chamber 72 if an opener is needed.

An outlet opening 83 is provided at the lower most portion 84 of the volume chamber 72. A diagonally downwardly extending conduit or elongated member generally designated by numeral 86 having an opening 88 formed there through is coupled to the lower most portion 84 of the volume chamber 72. The conduit 86 is provided with spaced parallelly aligned diagonally decending wall portions 89. A diagonally downward flow of oil is assured by the member 86 thus no oil will sit in the volume chamber 72. Accordingly proper flow of the oil is guaranteed from the volume chamber 72.

A hose 90 is coupled to the member 86 by a clamp 92. An adapter coupler (not shown) is secured to the hose 90 by a clamp 94. The adapter coupler may be the same as the adapter coupler 42 (FIG. 2) or the adapter coupler 58 (FIG. 3).

The invention has been shown and described in what is considered to be the most practical and preferred embodiment. However, it should be recognized that changes may be made by those skilled in the art without departing from the spirit and scope of the invention.

What is claimed:

1. In combination a vehicle having a vertically raised frame;

a volume chamber having inlet and outlet openings coupled to one side of the vehicle frame;

a motor, having an oil fill opening formed therein mounted on an intermediate front portion of portion of the vehicle frame, the frame being so vertically raised and the motor being mounted therein so that the oil fill opening is remotely displaced from access by a user;

a first means having spaced parallely aligned diagonally decending wall portions with first portions thereof coupled to the volume chamber in alignment with the outlet opening for directing oil flow diagonally downward from the volume chamber;

a second means coupled to second portions of the first means for directing the flow of oil from the first means to the motor oil fill opening;

means coupled to one side of the volume chamber for puncturing an oil container upon insertion of the container into the volume chamber so that oil will flow into the volume chamber from the container;

an elongated member having a plurality of threads formed thereon;

a stop coupled to one end of the elongated member;

a locking member threadedly coupled to the other end of the elongated member; and a gasket and washer mounted on the elongated member between the locking member and the stop so that upon movement of the locking member to a predetermined point adjacent the stop the gasket and washer are compressed by the locking member thereby forming a seal and locking the elongated member in place on the motor.

2. The combination of claim 1 wherein the volume chamber further includes:

a plurality of threads formed in an upper portion thereof adjacent the inlet opening and;

a cap having threads formed therein, that cooperate with the threads in the upper portion of the volume chamber so that the volume chamber can be sealed by the cap.

* * * * *